US010352063B2

(12) United States Patent
Jensen

(10) Patent No.: US 10,352,063 B2
(45) Date of Patent: Jul. 16, 2019

(54) PORTABLE DEMOUNTABLE CANOPY SYSTEM

(71) Applicant: Eva Christine Jensen, Long Island City, NY (US)

(72) Inventor: Eva Christine Jensen, Long Island City, NY (US)

( * ) Notice: Subject to any disclaimer, the term of this patent is extended or adjusted under 35 U.S.C. 154(b) by 0 days.

(21) Appl. No.: 15/927,212

(22) Filed: Mar. 21, 2018

(65) Prior Publication Data

US 2019/0093385 A1 Mar. 28, 2019

Related U.S. Application Data

(60) Provisional application No. 62/475,994, filed on Mar. 24, 2017.

(51) Int. Cl.

| | |
|---|---|
| ***E04H 15/42*** | (2006.01) |
| ***E04H 15/62*** | (2006.01) |
| ***E04H 15/60*** | (2006.01) |

(52) U.S. Cl.

CPC ..... *E04H 15/42* (2013.01); *E04H 15/60* (2013.01); *E04H 15/62* (2013.01)

(58) Field of Classification Search

CPC ..... E04H 15/42; E04H 15/58; E04H 15/44; A45B 2023/0093

See application file for complete search history.

(56) References Cited

U.S. PATENT DOCUMENTS

| | | | | |
|---|---|---|---|---|
| 998,093 A * | 7/1911 | Hill | E04H 15/32 | 135/100 |
| 2,045,840 A * | 6/1936 | Davey | E04H 15/58 | 135/155 |
| 2,828,758 A * | 4/1958 | Moro | A45B 23/00 | 135/155 |
| 3,255,467 A * | 6/1966 | Kowalski | A45B 23/00 | 135/128 |
| 4,037,614 A * | 7/1977 | Hines | B62D 25/06 | 135/88.09 |
| 4,750,508 A * | 6/1988 | Tatoian | E04H 15/003 | 135/118 |
| 6,202,659 B1 * | 3/2001 | Sachs | A45B 17/00 | 135/142 |

(Continued)

OTHER PUBLICATIONS

No Author Listed, Canopy Tent Sandbags, Various images, Jan. 1, 2017, https://www.google.com/search?q=canopy+tent+sandbags&espv=2&biw=1846&bih=1252&tbm=isch&imgil=e6ydJYWleXEbXM%253A%253B6Gqdry7myDCSEM%253Bhttp%25253A%25252F%25252Fwww.sandbagstore.com%25252Fheduwhcatesa.html&source, USA.

(Continued)

*Primary Examiner* — Noah Chandler Hawk
(74) *Attorney, Agent, or Firm* — Milton L. Honig

(57) ABSTRACT

A portable demountable canopy system is provided including a canopy defined by a rim arranged around an outer periphery of the canopy, the rim forming an open area, and a rollable membrane deployed across the open area; a plurality of poles being attached to the canopy; and counterweight elements present in an amount at least equal to an amount of the poles, each of the counterweight elements along outer sides thereof fitted with at least two fastening elements for receiving a lower end of each pole. Also disclosed is a kit with parts for assembling the system.

19 Claims, 8 Drawing Sheets

(56) References Cited

U.S. PATENT DOCUMENTS

| | | | | |
|---|---|---|---|---|
| 8,424,549 | B1 * | 4/2013 | Goldsmith | E04H 15/60 135/116 |
| 8,439,058 | B2 * | 5/2013 | Doell | E04H 12/2246 135/118 |
| 8,714,174 | B1 * | 5/2014 | DeSousa | E04H 15/58 135/117 |
| 2013/0240007 | A1 * | 9/2013 | Ashton | E04H 15/58 135/161 |

OTHER PUBLICATIONS

Paola Lenti, Paola Lenti, Pavilion, Jan. 1, 2017, http://www.paolalenti.it/en/product/show/pavilion/, Italy.

Lawski Design, Temporary Roofing System, Jan. 1, 2017, http://lawski-design.pl/portfolio_page/temporary-canopy-shelter-system/, Poland.

The Sandbag Store, Sandbags Canopy™, Canopy Sand bags Black 4 Pack, Jan. 1, 2017, http://www.sandbagstore.com/hedublcatesa.html, USA.

Brown Jordan, Midcentury Sunshade, Jan. 1, 2017, http://www.dwr.com/outdoor-umbrellas/midcentury-sunshade/942.html?lang=en_US#lang=en_US&adpos=1t1&creative=210497450603&device=c&matchtype=b&network=g&mrkgadid=1055579566&mrkgcl=609&rkg_id=h-9742aaca3b44b1e485bc32a09ce39740_t-152080307&gclid=EAIaIQobChMIhLTWtqzI2QIVAVcNCh0NmQtmEAA-YASAAEgKChfd_BwE&start=1, USA.

NG Design, Umbrosa, Eclipsum, Jan. 1, 2017, https://www.umbrosa.be/en/parasol-collection/eclipsum-umbrella, Belgium.

Shadecraft Robotics, Sunflower™, Jan. 1, 2017, https://www.shadecraft.com/product, USA.

* cited by examiner

PORTABLE DEMOUNTABLE CANOPY SYSTEM

BACKGROUND OF THE INVENTION

Field of the Invention

The invention is concerned with a portable demountable canopy system for quick assembly and disassembly, the system being suitable for outdoor and (selective) indoor placement with the ability of being a smart canopy system hub. The system is namely concerned with providing a space for protection from the sun, but also provides for other functions.

The Related Art

Tents and protective portable canopies are in wide use. They are available through large venders including IKEA, AMAZON and HOME DEPOT. None of these type of products fully meet the needs of being portable, readily mountable/demountable and having built-in seatability. See https://www.google.com/search?q=canopy+tent+sandbags&espv=2&biw=1846&bih=12 52&tbm=isch&imgil=e6y-dJYWleXEbXM%253A%253B6Ggdry7myDCSEM%253-Bhttp%25253A%25252F%25252Fwww.sandbagstore.com%25252Fheduwhcatesa.html&source=.

Paola Lenti has created sun shade structures known as patio umbrellas. Similar to ordinary hand held rain umbrellas, most of the Lenti products are supported by a centrally positioned single poll. Other canopy type Lenti products are tent structures. Most require tedious and expensive anchoring into the ground. See http://www.paolalenti.it/en/product/show/pavilion/.

Lawski Design has developed a temporary canopy shelter system. Assembly of this system is time consuming and laborious, and the tent canopy encloses the sides offering little outward visibility, while the counterweights merely stand on one or more unsecured spindly pole feet, and is woefully unstable. See http://lawski-design.pl/portfolio_page/temporary-canopy-shelter-system/.

Sandbags Canopy™ has created a tent with four poles, each being supported by a sandbag counter weight. See http://www.sandbagstore.com/hedublcatesa.html. A problem with this design is the numerous supporting tubular beams needed to support the tent canopy. As a consequence, the canopy cannot be quickly assembled and disassembled, and the sandbags are applied as an afterthought, not integrated into the design, only serving as counterweight, positioned and scaled as a potential trip hazard.

Brown Jordan markets midcentury sunshades. These products feature a flat round disc angularly adjustable. The disc is supported by a single poll attached along an edge of the disc. The size of the disc (and thereby sunshade) is extremely limited by the feeble support, and the shade membrane weave quite open providing for little shade. See http://www.dwr.com/outdoor-umbrellas/midcentury-sunshade/942.html?lang=en_US#lang=en_US&adpos=1t1&creative=210497450603&device=c&matchtype=b&network=q&mrkqadid=1055579566&mrkgcl=609&rkg_id=h-9742aaca3b44b1e485bc32a09ce39740_t-1520808307&gclid=EAlalQobChMlhLTWtqzl2QlVAVaNCh0NmQtmEAAYASAAEgKChf D_BwE&start=1

Umbrosa, a Belgium shade umbrella company markets, Eclipsum: a large circular shade disc, pitchable, mounted to a single pole that requires a large base for permanent mounting to ground as counterweight provision, and therefore not portable. The shade membrane is (dense) not breathable, and requires to be de-installed when not in use in order to prevent uplift and wind damage issues. See https://www.umbrosa.be/en/parasol-collection/eclipsum-umbrella Shadecraft robotics has developed a smart sun umbrella "Sunflower" as an outdoor hub, outfitted with sensors that sends signals to a rotating and self-pitching arm. It is still, however, designed as a classic sun umbrella with a single pole in the middle and a large base to hold it up limiting the actual free space under the canopy as well as the diameter of the sun umbrella span, and in turn the actual reach of protection from the sun. See https://www.shadecraft.com/product

SUMMARY OF THE INVENTION

A portable demountable canopy system is provided which includes:

a) a canopy defined by a rim arranged around an outer periphery of the canopy, the rim forming an open area, and a rollable or foldable membrane deployed across the open area;

b) a plurality of poles, each pole having an upper and a lower end, the poles being attached to the canopy; and c) a plurality of counterweight elements present in an amount at least equal to an amount of the plurality of poles, each of the counterweight elements along sides thereof fitted with a fastening element for receiving the lower end of each pole.

In some embodiments the counterweight elements may include hollow space for storage of batteries and smart hub technology (IoT) as wifi "hot spot" router, sensor equipment parts relating to light and sound controls for smart technology and future robotics technology.

The rim and canopy may be designed to harvest energy from the sun, and have the ability to be outfitted with both sensors for various purpose and solar cells for producing energy to charge a battery (batteries) stored in the counterweight for LED lighting in the canopy and as a smart station. The smart functions can be controlled by sensors and or by hereto developed app for smart phones and tablets.

BRIEF DESCRIPTION OF THE DRAWINGS

Further features and advantages of the invention will become more readily apparent upon considering the detailed description and the accompanying drawings wherein.

DETAILED DESCRIPTION OF THE INVENTION

Herein described is a relatively low cost, portable and demountable canopy system conceived as a minimal and clean design emphasizing simplicity, transparency and versatility. The design is concerned with enhancing the quality of outdoor living, and can be installed in many of the new types of outdoor recreational spaces that are constructed today. Placed outdoors the system provides protection from the sun without risking sun damage to skin, and offers shelter from rain. With applied sun protection to skin, as required, it also serves as a place to enjoy the sun. Moreover, the set of counterweight elements can provide multiple benefits including being a seat, a display pedestal for vendors and step stool during assembly. Assembly by one or two persons can be achieved within 5-10 minutes. The canopy system synthesizes renewal of current shade structures and portable tent concepts. It eliminates the center pole of traditional parasols, opening and closing maintenance of an umbrella and offers an alternative to square tent pavilions while integrating the counterweights as furniture.

The canopy system (Circle Shade™) concept is designed for installation as a single unit or in a constellation of multiple units from two to twenty or as many as there is space available. The canopy system can be installed in a dynamic variation of spaces (typologies) as either an analog or smart hub canopy system:

Some type of spaces for installation, but not limited to are:

In the Public Realm including parks, urban waterfront, campuses, schools and kindergartens;

At Beaches for sun protection—(beach model);

In the hospitality sector and residential garden environments—(upscale model);

At large indoor/outdoor fairs and events; and

As a sustainable model for energy harvest/smart hub/charging station—as a relief effort station (portable unit/kit of parts for shipping to disaster areas).

Figure 1A:
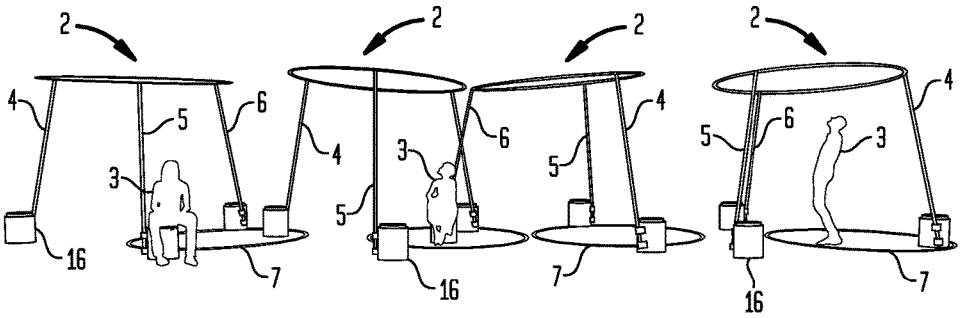
FIG. 1*a* is a perspective view of a grouping of a first embodiment of the canopy system with each canopy positioned in a slightly different direction.

FIG. 1*a* illustrates a first embodiment shown in four rotated views. A canopy 2 is supported by a tripod arrangement of two long poles 4, 5 and a short pole 6. Human FIG. 3 in standing and sitting positions and canopy shadows 7 are provided to illustrate spatial and relative height context. In the shown embodiment, the major plane coincident with the canopy is oriented at an angle between 2 and 8 degrees relative to a plane defined by the ground. Other embodiments may have a canopy tilt between 0 and 90 degrees, often between 2 and 60 degrees, and frequently between 6 and 30 degrees. Tilt need not require different pole lengths. A set of poles of equal length may achieve tilt by sufficient offset of a counterweight element 16 (to which the pole is attached) relative to other counterweight elements. Alternatively, tilt can be achieved by a pitchable connector node joining a pole to the rim of the canopy.

Figure 1B:
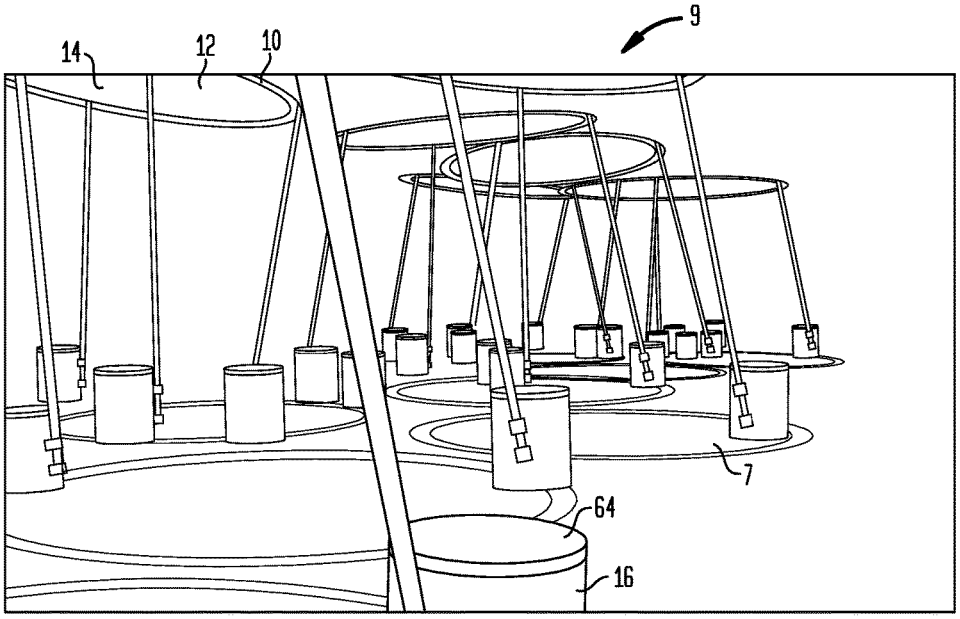
FIG. 1*b* is a perspective view through a constellation of canopy systems with each offset from an adjacent system.

FIG. 1*b* best illustrates a constellation 9 of canopy systems. The constellation is arranged to provide an extended set of canopy shadows 7. These shadows may overlap adjacent shadows or as illustrated be non-overlapping.

The canopy is constructed of a round rim 10 tracing a periphery of the canopy. A circular rollable membrane 12 is deployed across an open area 14 within the rim. In other embodiments the canopy may have other than a round shape. Alternatives include shapes that are oval or polygonal, the latter including square, rectangular, hexagonal and octahedral shapes. Concommitantly, the number of poles and counterweight elements may need to be increased. For example, the numbers of poles may range from four to one hundred, and the number of counterweight elements may range from four to one hundred.

The canopy system can be designed to harvest energy from the sun, and have the ability to be outfitted with both sensors for various purposes and solar cells for producing energy to charge battery (batteries) stored in counterweight elements for LED lighting in canopy and as smart station (IoT) for future WiFi and charging station. The smart functions can be controlled by sensors and/or by hereto developed app for smart phones/tablets and other computer devices.

Figure 2:
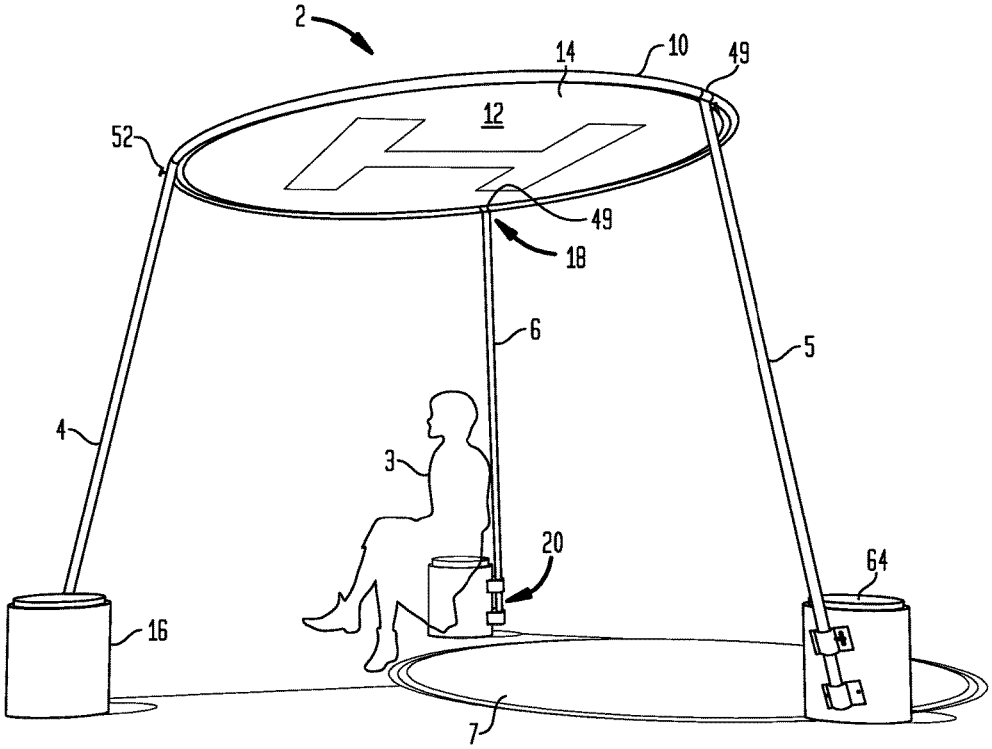
FIG. 2 is a perspective view of a single canopy system per the FIG. 1 embodiment which is presented in greater detail.

FIG. 2 provides an expanded view of the first embodiment. Each of the three poles have upper and lower ends 18, 20. The upper ends attach to the canopy while the lower ends are each held in a respective one of three counterweight elements 16. The poles may be made as one piece, but can also be made in several pieces and connected with an easy and quick ball and hole insert connection system or other similar connection system. In certain embodiments the poles may be of solid rather than hollow tubular construction. Pole material may be of aluminum, plastic (e.g. PVC—polyvinyl chloride), wood or metallic alloys.

Rim 10 in a first embodiment is segmented into three hollow curved tubular parts 22. Aluminum rods are particularly preferred both for the three curved tubular parts and for the poles. Other suitable materials may be plastics, wood or metallic alloys. Alternative embodiments may have non-segmented rims or segmented from two to a hundred tubular parts depending on rim size. Although hollow tubular parts are preferred, some embodiments may have non-hollow, solid cores.

Figure 3A:
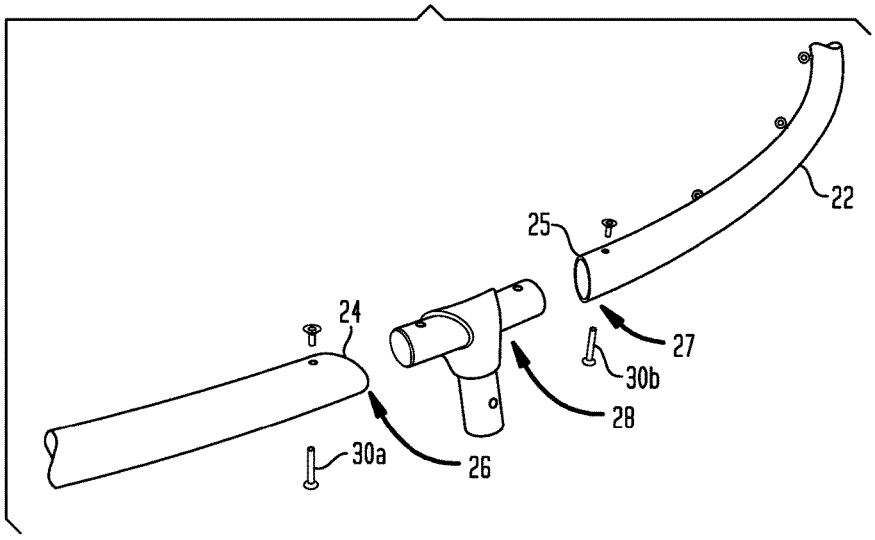
FIG. 3*a* is a partial perspective view of two rim segments in position awaiting connection via a connector node.

FIG. 3*a* best illustrates oblique angular cuts 24, 25 at first and second ends 26, 27 of the tubular parts. These ends can also be cut at a straight angle. A connector node 28, made of any malleable and/or formable material including materials constructed by 3D printing, joins the first and second ends of adjacent tubular parts.

Figure 3B:
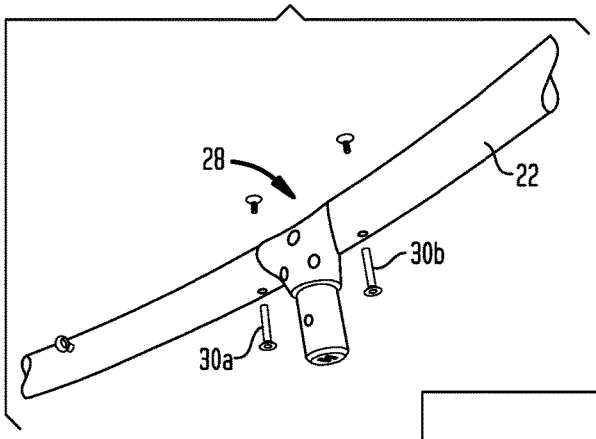
FIG. 3*b* is a partial perspective view of rim segments, the two rim segments shown in FIG. 3*a* now being joined via a connector node.
Figure 3C:
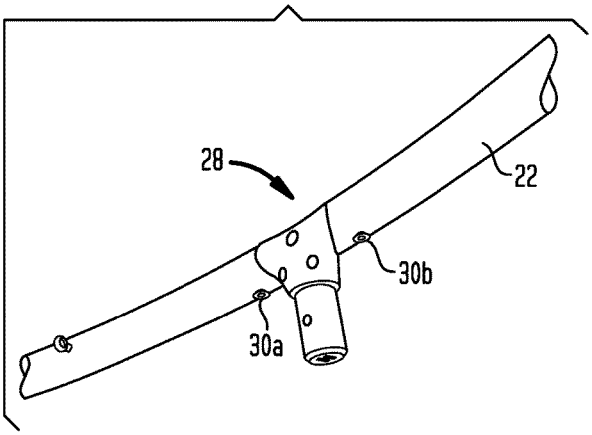
FIG. 3*c* is a partial perspective view of rim segments, the two rim segments shown in FIG. 3*b* now being secured by screws.

FIG. 3*b* reflects a second step in the joinder of tubular parts with the connector nodes. Also shown are a set of two flathead counter sunk screws 30*a*, 30*b* (Chicago screw system with a male and female interlocking screws) to fasten connector node to tubular parts. FIG. 3*c* illustrates the completed joinder.

Figure 3D:
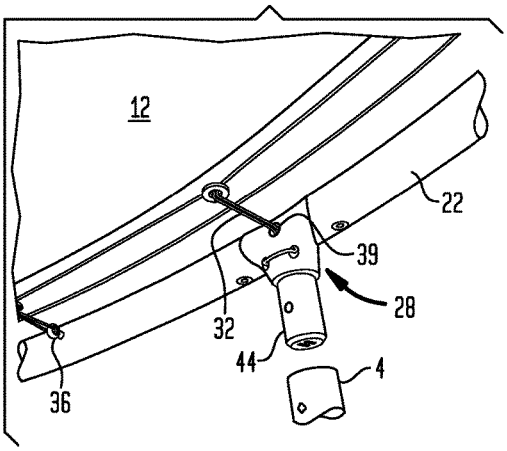
FIG. 3*d* is a partial perspective view of the joined rim segments shown in FIG. 3*c* now in the process of the rollable membrane being laced onto the rim and a connector node.

FIG. 3*d* shows the rollable membrane 12 being installed by threading of a rope 32 through grommeted eyelets 34 on the membrane with eye rings 36, or integrated rim apertures at node joints, of the tubular parts. The rope may be made of any strong construction including synthetic or plant origin fibrous material. Examples include UHMwPE and UHMW—thermoplastic polyethylene available from Dyneema, nylon (polyamide), polyester, polyacrylic, hemp and any combinations thereof.

Figure 3E:
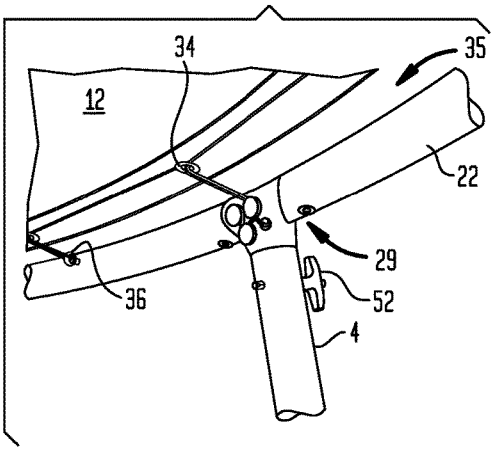
FIG. 3*e* is a partial perspective view of the joined rim segments shown in FIG. 3*d* now having a pole inserted into the connector node and secured by a T-handle pin fastener.

FIG. 3*e* demonstrates a subsequent assembly step wherein leg 44 of the connector node has been inserted into the hollow tubular pole 4.

Figure 3F:
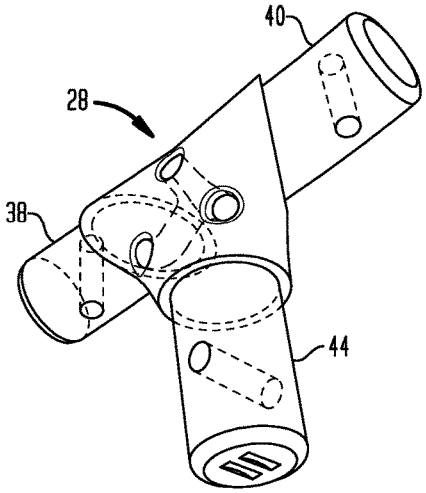
FIG. 3*f* is a perspective view of a connector node.

FIG. 3*f* shows in greater detail the connector node 28 employed with the FIG. 3*d* embodiment. The connector node features left and right arms 38, 39 respectively and a leg 44.

Figure 3G:
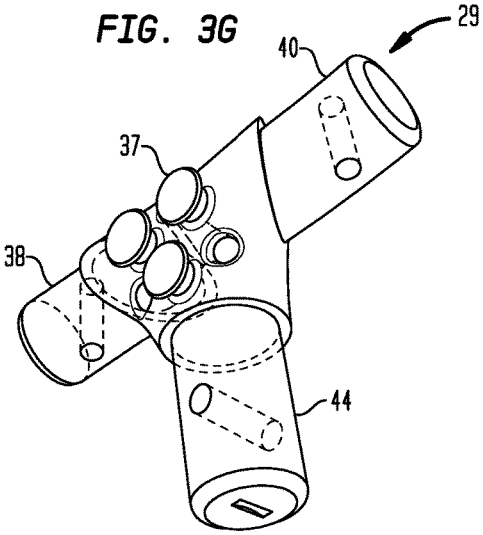
FIG. 3*g* is a perspective view of a connector node with cleats.

FIG. 3*g* provides more detail on a variant connector node 29 employed with the FIG. 3*e* assembly. The variant is a set of three cleats 37 functioning as anchors to secure ends of the threaded rope.

The rollable membrane 12 can be made of a variety of materials. A 3% openness factor, breathable outdoor shade fabric has proven to work well in the application like a textiline nano 97 twill, a two-sided synthetic fabric advertised to be able to block up to 97% of the sun's harmful rays. Other technical textiles for the membrane application can be coated PVC membrane types often used for architectural tent structures or awning canvas type textiles as well as future available smart textiles with solar cell or other sun energy harvesting incorporated devices.

A gap 35 of 1 to 3 inches, more broadly 0.5 to 12 inches between canopy rim and installed laced up membrane provides both for tolerance of membrane creep and as air flow gap to let wind pass through alleviating uplift tendencies. See FIG. 3*e*.

The canopy allows markings for branding, marketing or identification purposes seen at all times from top as well as underside of canopy. A business or institution logo, personal initials and coat of arms can as example be applied and as a disaster relief station Red Cross or other relief organization's logo can be applied as identification. These identification markings 13 are depicted only for location purposes.

Figure 6:
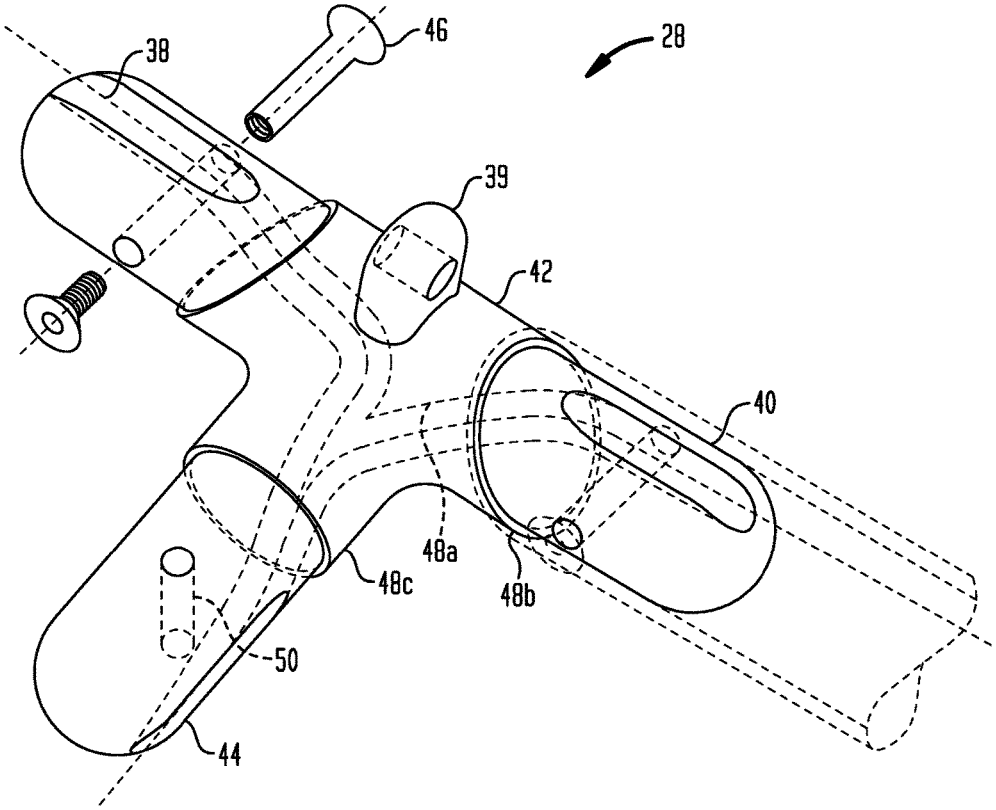
FIG. 6 is a perspective enlarged view of a connector node according to the first embodiment.

FIG. 6 offers still another detailed view of a translucent material connector node. Left and right arms 38, 40 stretch outward from a central sleeve 42. Leg 44 projects downwardly from the central sleeve. An eye ring 39, or aperture formed into a hollow channel of the rim, is integrally formed with the central sleeve and functions as earlier mentioned to receive the rope in securing the rollable membrane to the rim. A stainless steel flat head socket drive binding post (Chicago screw) 46 with plastic/neoprene washer is countersunk into the tubular part. Electrical channels 48*a*,48*b*, 48*c* are provided for integrated LED lighting 49 at multiple locations, particularly at the nodes, around the rim periphery. Along the leg 44 is positioned an (aperture) hole channel 50 to receive a matching quick release T-handle pin fastener 52.

Figure 5A:
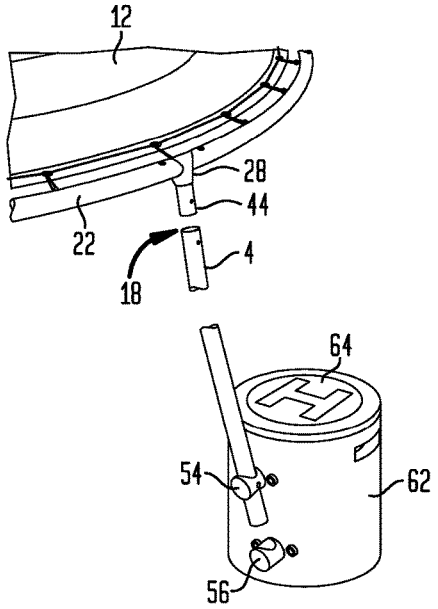
FIGS. 5*a-c* is a sequence illustrating connection of one of the poles to canopy and a counterweight element.
Figure 5B:
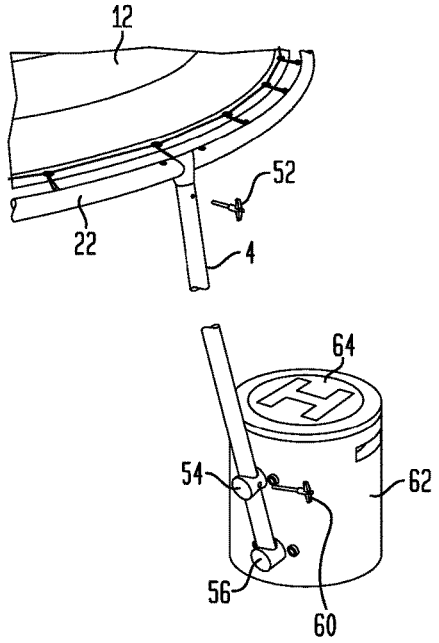
Figure 5C:
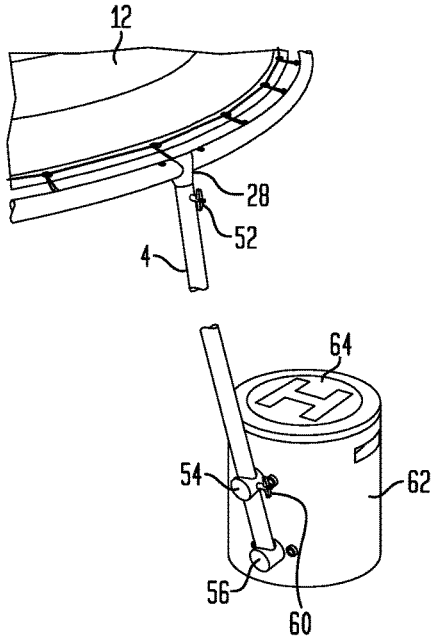
Figure 5D:
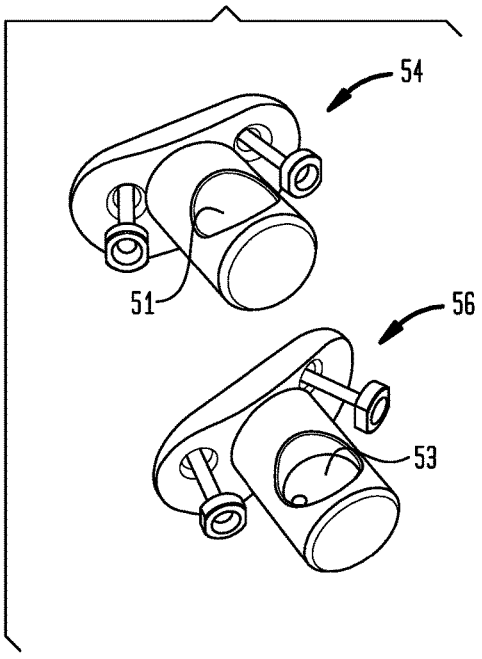
FIG. 5*d* is a perspective view of an upper and lower bracket employed to secure poles to counterweights.

FIGS. 5*a-c* focus on the connection of the poles to join the rim with the counterweight elements. FIG. 5*a* illustrates leg 44 being aligned with the upper end of hollow pole 4. The lower end of the hollow pole is engaged with a higher bracket 54 aligned for attachment to a surface of a counterweight element, particularly an element formed from concrete and having a hollow interior. FIG. 5*b* shows leg 44 inserted into the hollow pole. Also shown is the lower end of the pole inserted into a pair of angled vertically stacked aligned higher and lower brackets 54,56. Higher bracket 54 includes a passageway 51 open at opposite ends allowing the pole to fit through both ends. Lower bracket 56 has a modified passageway 53 open at the top end but closed at a bottom end to prevent further downward movement of the inserted pole. FIG. 5*d* best illustrates the pair of brackets.

Both brackets are secured to an outer surface 62 of the counterweight elements. T-handle pin fasteners 52,60 are positioned respectively near the upper and lower ends of the pole to tighten connections. FIG. 5*c* shows the fasteners in their tightened arrangement. The brackets can be made of any malleable and/or formable material and manufactured via 3D printing, mold cast or other manufacturing forms. They can be fastened from the front of the counterweight elements or designed as cylinder brackets mounted with back plates to the inside of the counterweight element with the bracket protruding outward through an opening in the counterweight element. All (low voltage) wiring may be wired from the rim through connector nodes, through poles with penetration to connector to smart control equipment stored in counterweight.

The counterweight elements 16 may have a closed or open bottom, and may either be solid or hollow. When hollow they can be filled with ballast such as water, sand, stone, metal, concrete or other counterweighting material. The elements can be fabricated totally of concrete without need for further ballast. Wood, plywood or metal usually need to receive additional ballast or be staked into the ground through integrated u-bent brackets.

Counterweight elements may also be constructed of a light weight material such as plastic or glass fiber reinforced plastic and receive ballast therein. Furthermore, the elements may be shaped other than round. Alternative shapes include oval, square, rectangular, pentagonal, hexagonal or any other polygonal shape.

Advantageously in one embodiment where the counterweights are hollow, the interior diameters of the hollow openings and heights are dimensioned to allow stackable nesting of the counterweights. The nesting (e.g. for three counterweights) permits a relatively more compact shipping and storage system.

In the first embodiment, a lid or flattened upper surface is formed on the counterweight element to function as a seat. Some variations on the element will have a hollow area therein to receive smart technology including a battery that can be charged by canopy solar cells, to provide power to LED lightening on the structure. In addition WiFi and sensor related equipment for lighting and sound control for smart technology integration and future robotics technology. The smart hub technology can have the ability to be a charging station, which would be helpful in urban environments, campuses and as portable/demountable relief effort stations.

Figure 4B:
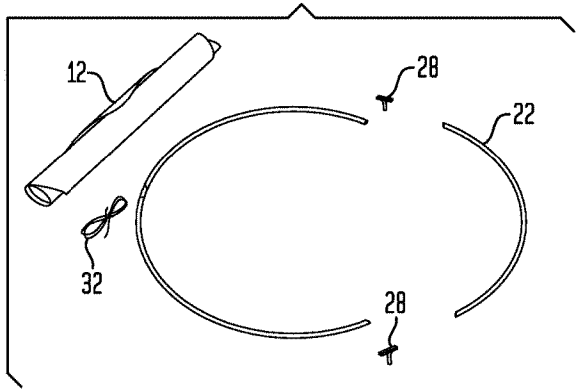
FIG. 4*b* is a perspective view of a partial assemblage of the rim segments with components displayed in FIG. 4*a;*
Figure 4D:
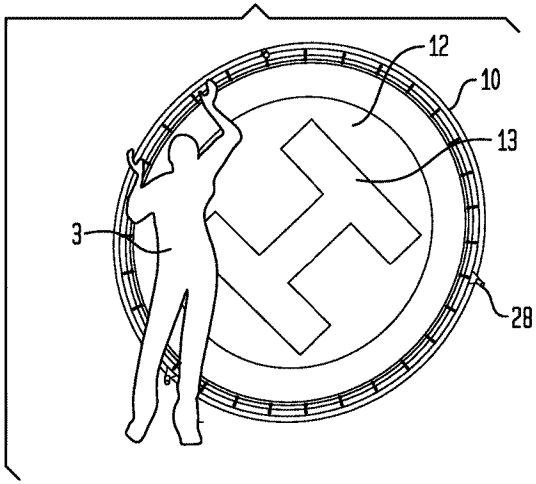
FIG. 4*d* is a perspective view of the completed canopy assembled (and able to roll to set up on location) in accordance with FIGS. 4*b* and 4*c;*
Figure 4A:
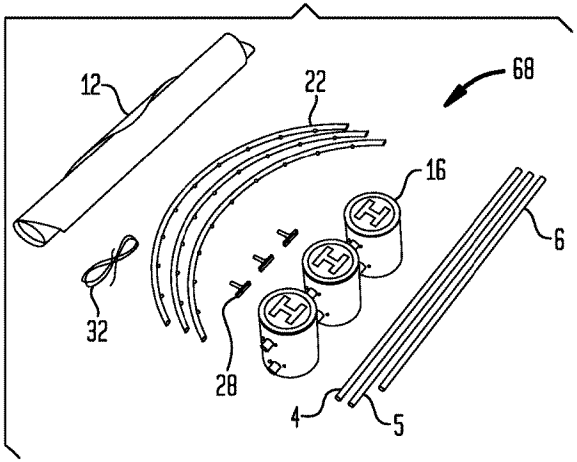
FIG. 4*a* is a perspective view of a flat package kit set of components needed to assemble the canopy system according to the first embodiment.
Figure 4C:
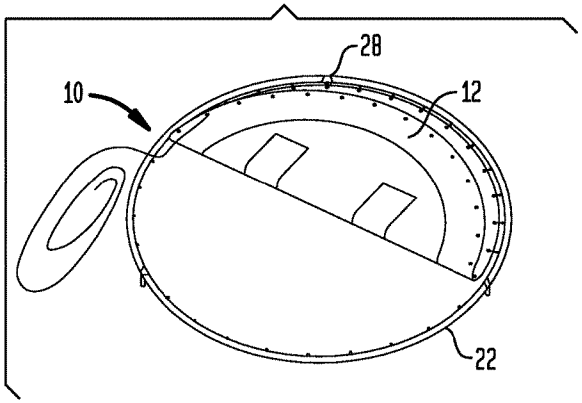
FIG. 4*c* is a perspective view of a rollable membrane being laced to the assembled rim formed per FIG. 4*b;*
Figure 4F:
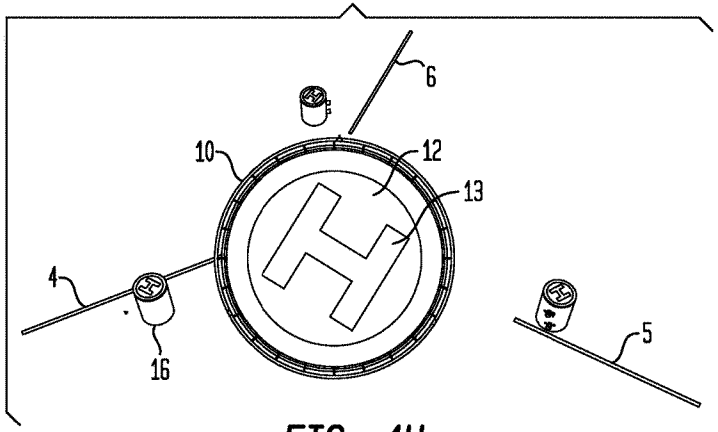
FIG. 4*f* is a perspective view of another step in the assembly of the canopy system.
Figure 4H:
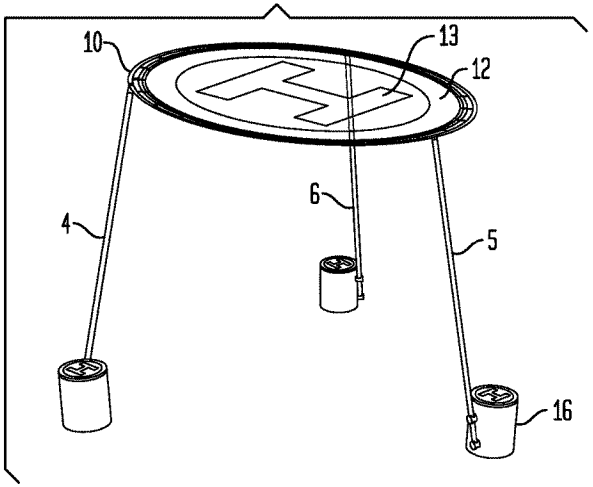
FIG. 4*h* is a perspective view of the canopy, counterweight elements and poles in final assembled form after the sequence shown in FIG. 4*a*-4*g;*
Figure 4E:
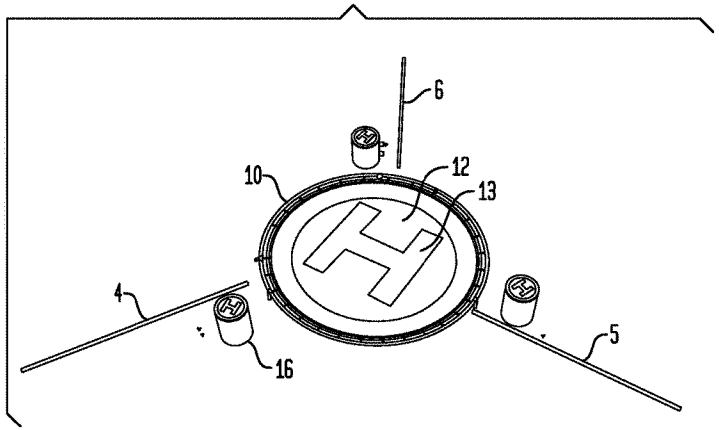
FIG. 4*e* is a perspective view of the assembled canopy as shown in FIG. 4*d* and further displaying poles and counterweights arranged for attachment to the canopy.
Figure 4G:
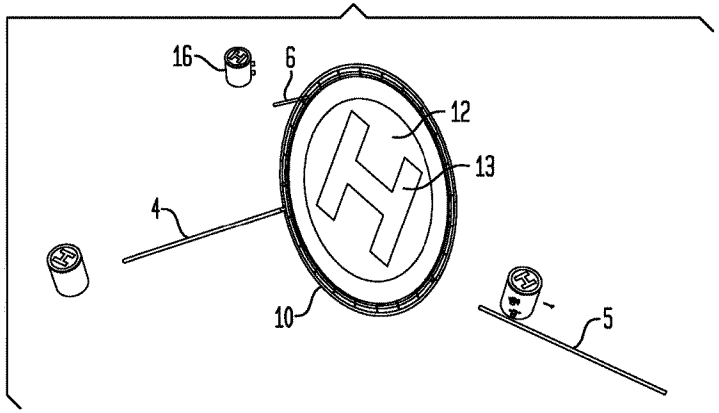
FIG. 4*g* is a perspective view of a final step in the assembly of the canopy system.

The structure is shippable in a flat pack kit 68 format from a manufacturer or distributor. FIG. 4*a* sets forth the kit components as rollable membrane 12, three tubular parts 22, three poles 4,5,6, three connector nodes 28, rope 32 and counterweight 16. FIG. 4*b* illustrates the assemblage of the rim 10. Shown in FIG. 4*c* is the rollable membrane 12 partially laced to half of the rim. FIG. 4*d* illustrates completion of the finished lacing of FIG. 4*c*. FIGS. 4*e-h* progressively show the final stages of assembly combining canopy and counterweight elements via the three poles.

Counterweight element fabrication to lightweight the system may use flat pack bendable plywood for assembly or concrete precursor in the form of dry concrete mix with form mold instructions to be poured.

In a variant embodiment of the flat pack kit, all parts are provided for assembling the canopy and the counterweights so that the canopy system parts once assembled for portable and demountable installation (Kit of Parts 4*e*) consist of 3 main components: 1 canopy, 3 poles and 3 counterweights, a total of only 7 parts, which assemblies quickly into one unit.

For the avoidance of doubt, the word "comprising" is intended to mean "including" but not necessarily "consisting of" or "composed of." In other words, the listed steps or options need not be exhaustive.

The disclosure of the invention as found herein is to be considered to cover all embodiments as found in the claims as being multiply dependent upon each other irrespective of the fact that claims may be found without multiple dependency or redundancy.

While the present structures and kits have been described with reference to the specific variations thereof, it should be understood by those skilled in the art that various changes may be made and equivalents may be substituted without departing from the true spirit and scope of the structures and kits described herein. All patents and publications cited above are hereby incorporated by reference.

What is claimed is:

1. A portable demountable canopy system comprising:

a) a canopy defined by a rim arranged around an outer periphery of the canopy, the rim forming an open area, and a rollable membrane deployed across the open area;

b) a plurality of poles, each pole having an upper and a lower end, the poles being attached to the canopy; and c) a plurality of counterweight elements, each of the counterweight elements being connected to a pole, each of the counterweight elements along sides thereof being fitted with a separate fastening element for receiving the lower end of each pole and wherein each of the counterweight elements is cast in concrete.

2. The system according to claim 1 wherein each of the counterweight elements has a closed flat upper surface to allow functionality selected from the group consisting of a seat, a display area, a step stool and combinations thereof.

3. The system according to claim 1 wherein the fastening element is two or more brackets.

4. The system according to claim 1 wherein the rim is segmented into parts.

5. The system according to claim 1 wherein the rim is segmented into from two to one hundred parts.

6. The system according to claim 1 wherein the canopy is tilted at an angle ranging from 0 to 90 degrees relative to ground upon which the canopy system stands.

7. The system according to claim 1 wherein the canopy is tilted at an angle of 6 to 30 degrees relative to ground upon which the canopy system stands.

8. The system according to claim 1 wherein the rim has a plurality of eye rings or integrated apertures and the rollable membrane has a plurality of eyelets.

9. The system according to claim 1 wherein the canopy and the rollable membrane are both round shaped and a gap between the membrane and rim of the canopy ranges from 0.5 to 12 inches.

10. A flat pack kit for assembling a portable demountable canopy system, the kit comprising:

a) a plurality of rim segments formable into a rim;

b) a plurality of connector nodes;

c) a plurality of poles which are three in number with two poles having an identical length and a third pole being shorter in length;

d) a plurality of counterweight elements each fitted along outer walls thereof with at least one separate fastening element for receiving a lower end of each pole; and e) a rollable membrane to be attachably deployed within the rim to form a canopy.

11. The kit according to claim 10 wherein the plurality of rim segments are from two to one hundred parts in number, the segments being hollow parts terminating in first and second ends.

12. The kit according to claim 11 further comprising connector nodes for joining the first and second ends of adjacent hollow parts, the connector nodes having a leg for engagement with one of the plurality of poles.

13. A portable demountable canopy system comprising:

a) a canopy defined by a rim arranged around an outer periphery of the canopy, the rim forming an open area, and a rollable membrane deployed across the open area;

b) a plurality of poles, each pole having an upper and a lower end, the poles being attached to the canopy; and c) a plurality of counterweight elements, each of the counterweight elements being connected to a pole, each of the counterweight elements along sides thereof being fitted with a separate fastening element for receiving the lower end of each pole, and wherein the plurality of poles are three in number, two of the poles having identical length and a third of the poles being shorter in length than the two identical length poles.

14. A portable demountable canopy system comprising:

a) a canopy defined by a rim arranged around an outer periphery of the canopy, the rim forming an open area, and a rollable membrane deployed across the open area;

b) a plurality of poles, each pole having an upper and a lower end, the poles being attached to the canopy; and c) a plurality of counterweight elements, each of the counterweight elements being connected to a pole, each of the counterweight elements along sides thereof being fitted with a separate fastening element for receiving the lower end of each pole, and wherein the rim is segmented into at least two hollow parts, each part having a first and second end, both the first and second ends being cut at an oblique angle.

15. The system according to claim 14 wherein each of the counterweight elements is hollow and fillable with sand or water in an amount to stabilize the system against collapse and further is fitted with a lid to allow a person to be seated thereon.

16. The system according to claim 14 further comprising a connector node for joining first and second ends of adjacent respective hollow parts, the connector node having left and right arms for fitting respectively into the first and second ends.

17. The system according to claim 16 to wherein the connector node further comprises a leg for engagement with one of the poles.

18. The system according to claim 17 wherein the connector node is rotatably adjustable thereby allowing the canopy to tilt at an angle ranging from 0 to 90 degrees relative to ground upon which the canopy system stands.

19. A demountable portable canopy system comprising:

a) a canopy defined by a rim arranged around an outer periphery of the canopy, the rim forming an open area, and a rollable membrane deployed across the open area;

b) a plurality of poles, each pole having an upper and a lower end, the poles being attached to the canopy; and c) a plurality of counterweight elements, each of the counterweight elements being connected to a pole, each of the counterweight elements along sides thereof being fitted with a separate fastening element for receiving the lower end of each pole, and wherein the rim has a plurality of eye rings or integrated apertures and the rollable membrane has a plurality of eyelets.

* * * * *